US010625921B2

(12) United States Patent
Johnson et al.

(10) Patent No.: US 10,625,921 B2
(45) Date of Patent: Apr. 21, 2020

(54) INTEGRATED ANTI-SPILL CONTAINER

(71) Applicant: Munchkin, Inc., Van Nuys, CA (US)

(72) Inventors: Kevin Douglas Johnson, Tarzana, CA (US); Mark A Hatherill, Agoura Hills, CA (US); Mark Gerard Tebbe, Ventura, CA (US); Adlin Aslan, Pasadena, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 100 days.

(21) Appl. No.: 15/703,963

(22) Filed: Sep. 13, 2017

(65) Prior Publication Data

US 2018/0099805 A1 Apr. 12, 2018

Related U.S. Application Data

(60) Provisional application No. 62/462,328, filed on Feb. 22, 2017, provisional application No. 62/407,428, filed on Oct. 12, 2016.

(51) Int. Cl.
*B65D 81/32* (2006.01)
*A47G 19/22* (2006.01)
(Continued)

(52) U.S. Cl.
CPC ..... *B65D 81/3205* (2013.01); *A47G 19/2222* (2013.01); *A47G 19/2272* (2013.01); *B65D 11/02* (2013.01); *B65D 11/1866* (2013.01); *B65D 21/0233* (2013.01); *B65D 25/04* (2013.01); *B65D 25/282* (2013.01); *B65D 43/0204* (2013.01); *B65D 43/0212* (2013.01); *B65D 51/1644* (2013.01); *B65D 51/28* (2013.01); *B65D 85/72* (2013.01); *B65D 2205/02* (2013.01); *B65D 2543/0037* (2013.01);
(Continued)

(58) Field of Classification Search
CPC ..... B65D 51/28; B65D 81/3205; A47G 2400/062; A47G 19/2272; A47G 19/30; A47G 19/2222
See application file for complete search history.

(56) References Cited

U.S. PATENT DOCUMENTS 8,302,798 B2 11/2012 Moss
2002/0145000 A1 10/2002 Li
(Continued)

FOREIGN PATENT DOCUMENTS

CN 103523359 6/2017

OTHER PUBLICATIONS

International Search Report and Written Opinion for PCT/US2017/055921 dated Dec. 21, 2017, dated Dec. 21, 2017. (pp. 23).

*Primary Examiner* — Mollie Impink
(74) *Attorney, Agent, or Firm* — Robert Z. Evora, Esq.

(57) ABSTRACT

A spill proof integrated container having a flexible cover, a snack container, a beverage cup and a straw. The snack container is attached to the beverage container. The snack container has a straw port. The flexible cover is secured over at least the snack container and has a diaphragm with slit openings formed through the diaphragm in order to access a first compartment within the snack container. The integrated container being useful for carrying both snacks and a beverage, all within a single integrated container.

20 Claims, 17 Drawing Sheets

(51) Int. Cl.

| | |
|---|---|
| ***B65D 51/28*** | (2006.01) |
| ***B65D 51/16*** | (2006.01) |
| ***B65D 25/04*** | (2006.01) |
| ***B65D 25/28*** | (2006.01) |
| ***B65D 21/02*** | (2006.01) |
| ***B65D 43/02*** | (2006.01) |
| ***B65D 8/00*** | (2006.01) |
| ***B65D 6/24*** | (2006.01) |
| ***B65D 85/72*** | (2006.01) |

(52) U.S. Cl.
CPC ..... *B65D 2543/00046* (2013.01); *B65D 2543/00092* (2013.01); *B65D 2543/00648* (2013.01); *B65D 2543/00842* (2013.01)

(56) References Cited

U.S. PATENT DOCUMENTS

| | | | | |
|---|---|---|---|---|
| 2003/0089725 | A1 | 5/2003 | Moss | |
| 2015/0102029 | A1* | 4/2015 | Bargiel ..... | A47G 19/22<br>220/23.89 |

* cited by examiner

INTEGRATED ANTI-SPILL CONTAINER

CROSS REFERENCE TO RELATED APPLICATION

This application claims priority to U.S. Provisional Application Ser. No. 62/462,328 filed Feb. 22, 2017 and to U.S. Provisional Application Ser. No. 62/407,428 filed Oct. 12, 2016; the contents of all of which are hereby incorporated by reference herein in their entirety into this disclosure.

TECHNICAL FIELD

The subject disclosure relates to an integrated anti-spill snack and drinking container. More particularly, to a self contained drinking container having a spill proof removable snack container portion capable of holding small items disposed within the drinking container.

BACKGROUND

Various types of containers are known that carry snacks and hold beverages. All too often, small children learning to feed themselves spill their cups and/or their snack containers resulting in making a mess of the snacks and/or drink onto the floor, themselves or other surfaces. Carrying various containers for a child's snacks and another for their drink can become quite cumbersome and undesirable to carry on the go. There is a need for the development of a spill proof container capable of simultaneously holding both a beverage and small items of food in a single container.

SUMMARY

A spill proof integrated container having a flexible cover, a snack container, a beverage cup and a straw. The snack container is attached to the beverage container. The snack container has a straw port. The flexible cover is secured over at least the snack container and has a diaphragm with slit openings formed through the diaphragm in order to access a first compartment within the snack container. The integrated container being useful for carrying both snacks and a beverage in a single integrated container.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1:
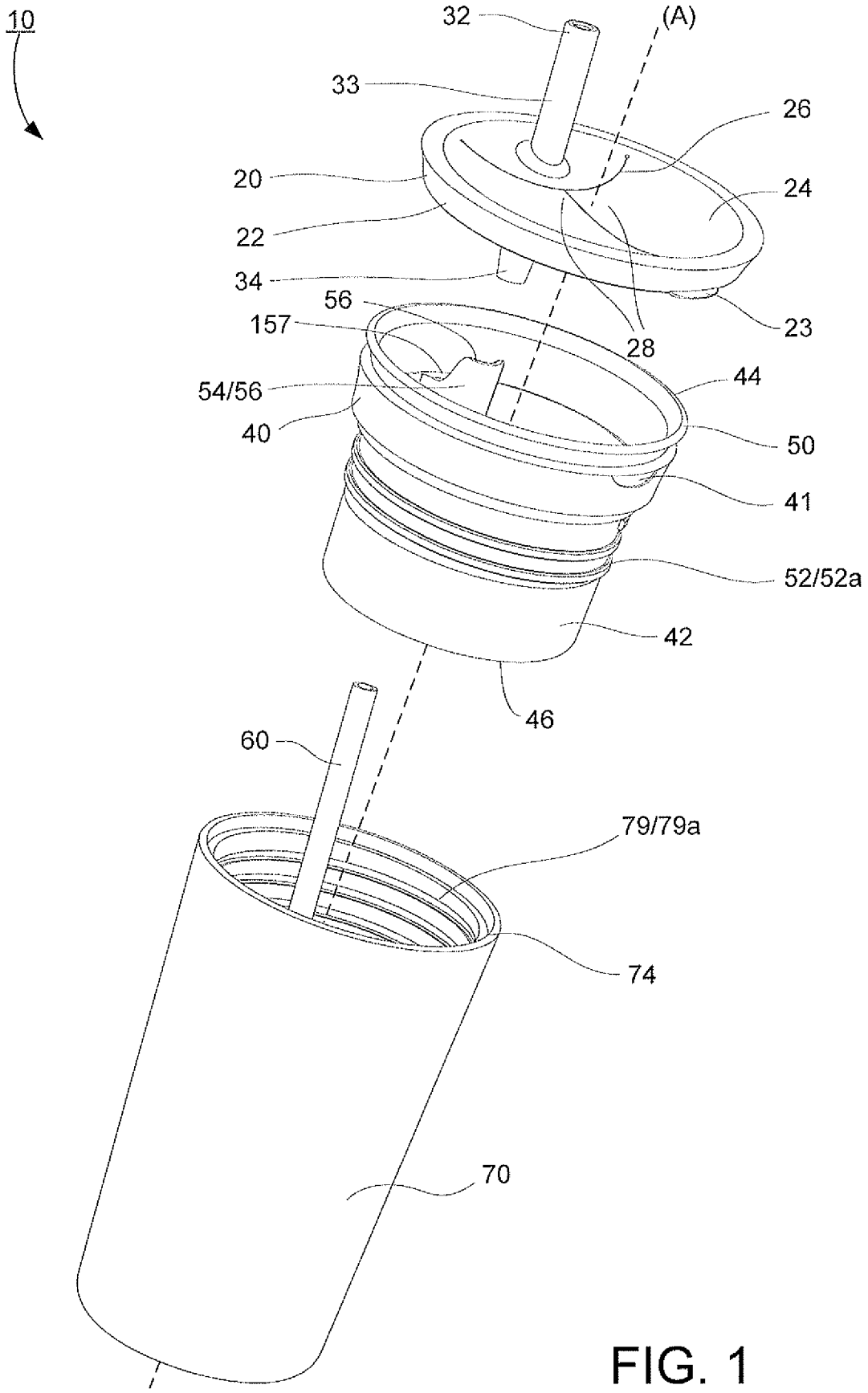
FIG. 1 illustrates an exploded perspective view of the integrated container according to the subject disclosure.

Particular embodiments of the present invention will now be described in greater detail with reference to the figures.

FIGS. 1-16 show various views of an integrated container 10 according to this subject disclosure. The integrated container 10 includes a flexible cover 20, a first container 70, a second container 40 and a straw 60. The integrated container 10 is useful for carrying a variety of different items, such as snacks and a beverage, in the single self-contained integrated container. Various other items can be stored in the integrated container 10 as will be described in more detail below.

The integrated container 10 is spill proof. If the integrated container 10 is tipped over, the liquid contents and/or the solid contents will remain within their respective compartments. The integrated container 10 can be adapted to carry various types of liquid substances, such as water, juice, soda and/or other liquids, or small substances, such as cereal, crackers, cookies, small apple slices, grapes, strawberries, banana slices and/or other small items, in the first container 70. The integrated container 10 can also be adapted to carry various types of small substances in the second container 40 such as cereal, crackers, cookies, small apple slices, grapes, strawberries, banana slices and/or other small items or the like. It is also contemplated that various size embodiments of the integrated container can also be adapted to carry larger substances in the first and/or second containers for a verity of different purposes, such as gasoline, air filters, nuts, bolts, jewelry, etc.

Various additional features may be added to the integrated container 10 according to this subject disclosure. For example, a rubber sleeve or other gripping elements (not shown) may be provided around the integrated container 10 to assist the user with gripping the integrated container 10. The integrated container 10 may be made of a durable resilient material designed to take numerous falls without breaking and so that the contents therein do not fall or spill from the integrated container 10.

Figure 6:
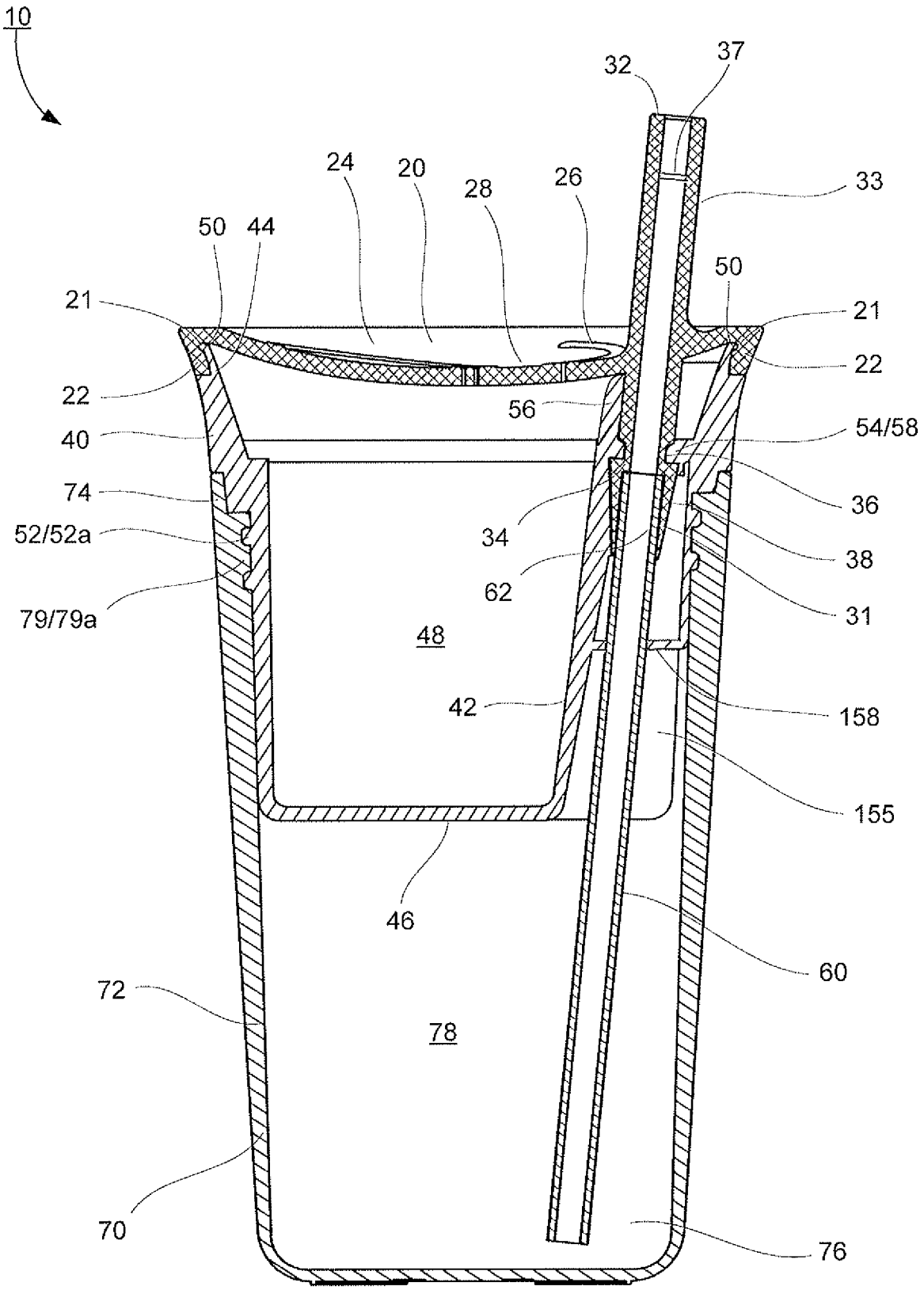
FIG. 6 is a cross section view of the integrated container.

In FIGS. 1-13, the flexible cover 20 depicts a flexible portion or diaphragm 24 that extends across and covers a first open end 44 of the second container 40 when the flexible cover 20 is detachably attached to the second container 40. The flexible cover 20 may be attached to the second container 40 by a variety of different methods, including but not limited to friction fit, snap-lock, screw-on, hinges, click-on and the like. As shown in FIGS. 6 and 8, the flexible cover 20 can be constructed for use concave or convex in shape.

Figure 17:
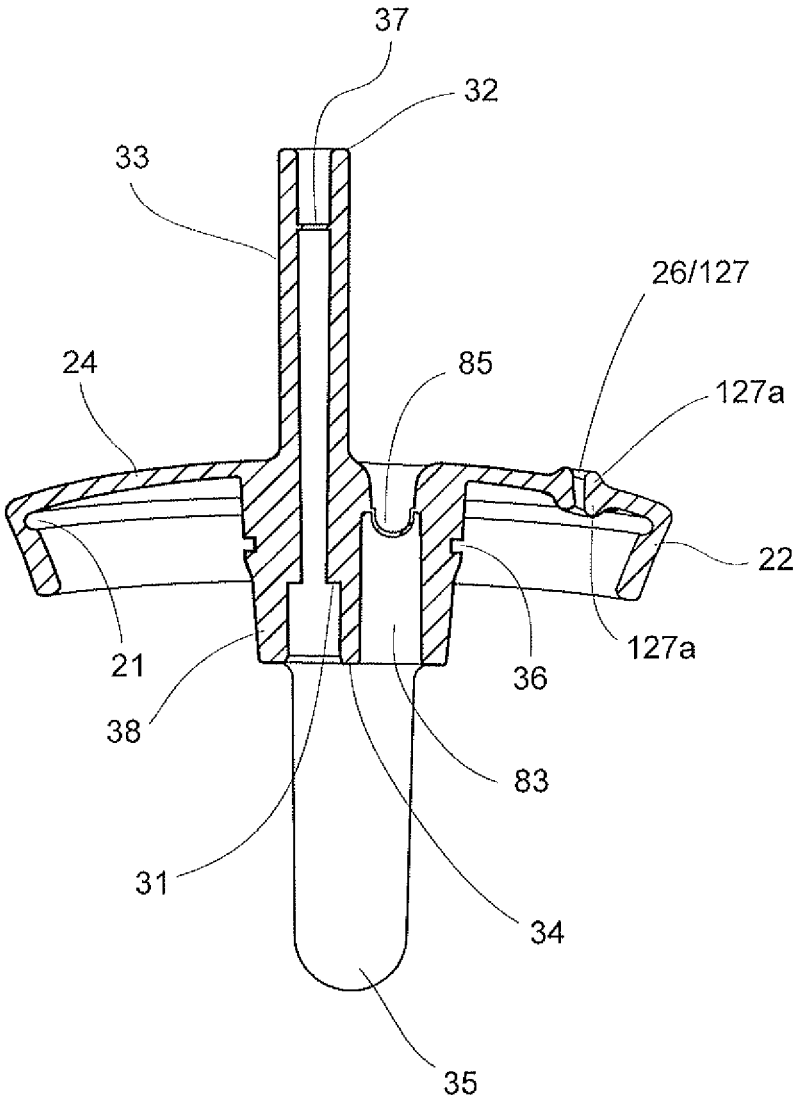
FIG. 17 is a cross section view at A-A of the flexible cover in FIG. 13.

As shown in FIGS. 2, 4-13 and most clearly in FIG. 17, the flexible cover 20 includes an annular flange 22 made of a resilient material that extends around and is secured to an outer periphery of the second container 40. The annular flange 22 may be formed integrally with a flexible portion or diaphragm 24 or as a separate component.

As shown in FIGS. 6 and 17, the annular flange 22 may include an annular recess 21 designed to receive an outwardly projecting lip 50 on second container 40, thus allowing the flexible cover 20 to be removably secured to the projecting lip 50 on the second container 40. Alternatively, the flexible cover 20 may be constructed to instead include an outwardly projecting lip and the second container 40 may contain an annular recess. Similarly, projecting lip 50 may be disposed on an inner periphery of the second container 40 and the flexible cover 20 may have an outwardly facing annular recess 21 that mates with the projecting lip 50, such that the mating connection occurs inside of the second container 40.

FIGS. 6, 8 and 14-16 show the flexible cover 20 may be detachably secured to the second container 40 by snapping the annular flange 22 over the container lip 50. The flexible cover 20 is attached to the second container 40 in a sufficiently secure manner to prevent its removal by a young child. To remove the flexible cover 20, the annular flange 22 of the flexible cover 20 may be peeled or pulled upwardly or outwardly away from a side of the container lip 50.

FIGS. 1-2 and 4-5 illustrate the second container 40 may include a recess 41 into which a user's finger may be slightly inserted to reach below and hook the flexible cover 20 to remove it. In addition, the flexible cover 20 may also have a tab 23. To remove the flexible cover 20, the tab 23 on the annular flange 22 may be pulled and stretched upwardly and outwardly from the second container lip 50 thus freeing the flexible cover 20 from the second container 40. The second container 40 may also include the recess 41 that aligns with the tab 23 into which a user's finger may be slightly inserted to reach below a lip of the tab 23 of the annular flange 22. Alternatively, any conventional means, such as a screw top, click-on, hinges, or the like can be used to detachably secure the flexible cover 20 to the second container 40.

Figure 2:
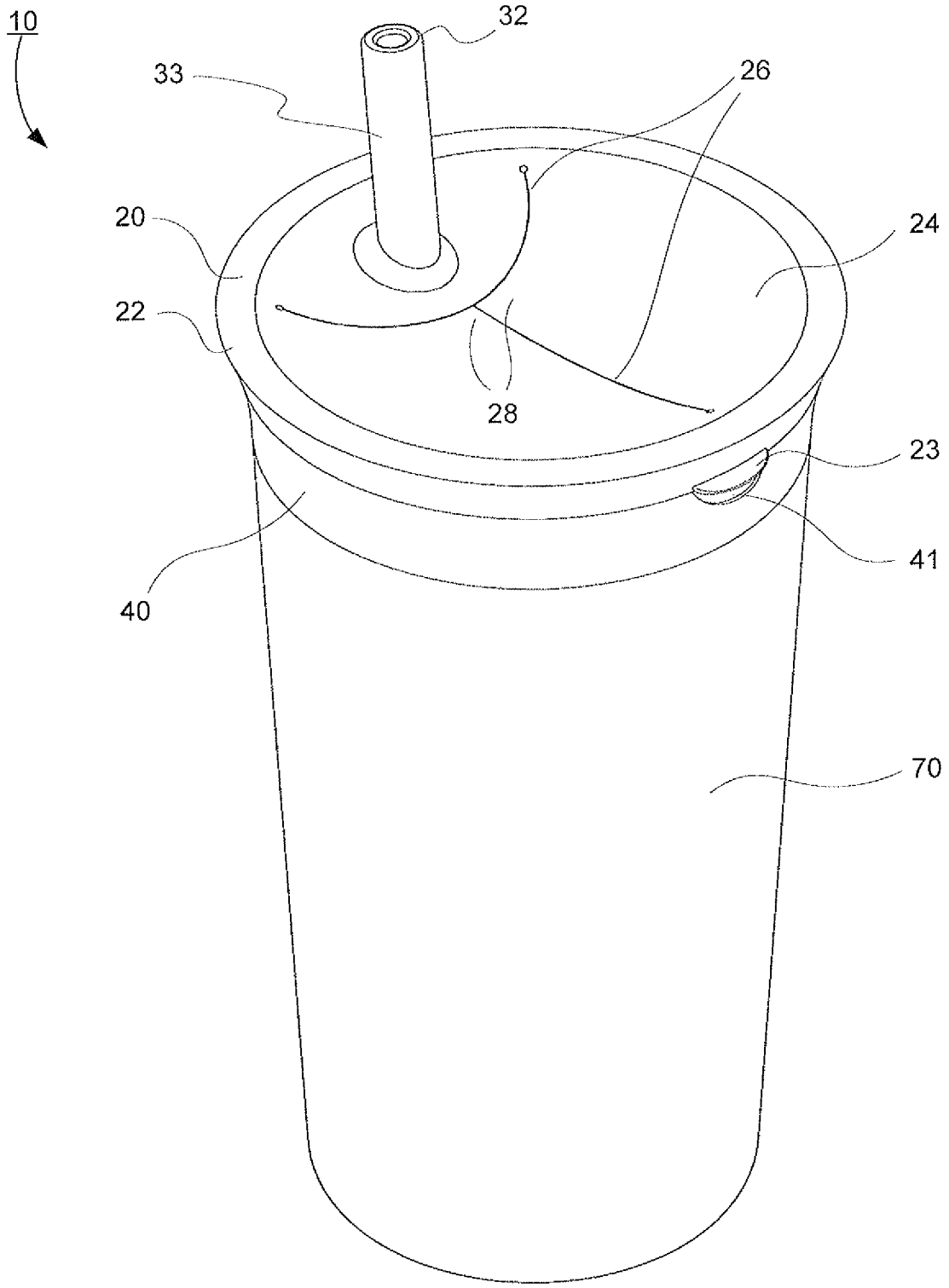
FIG. 2 is an upper perspective view of the integrated container.
Figure 3:
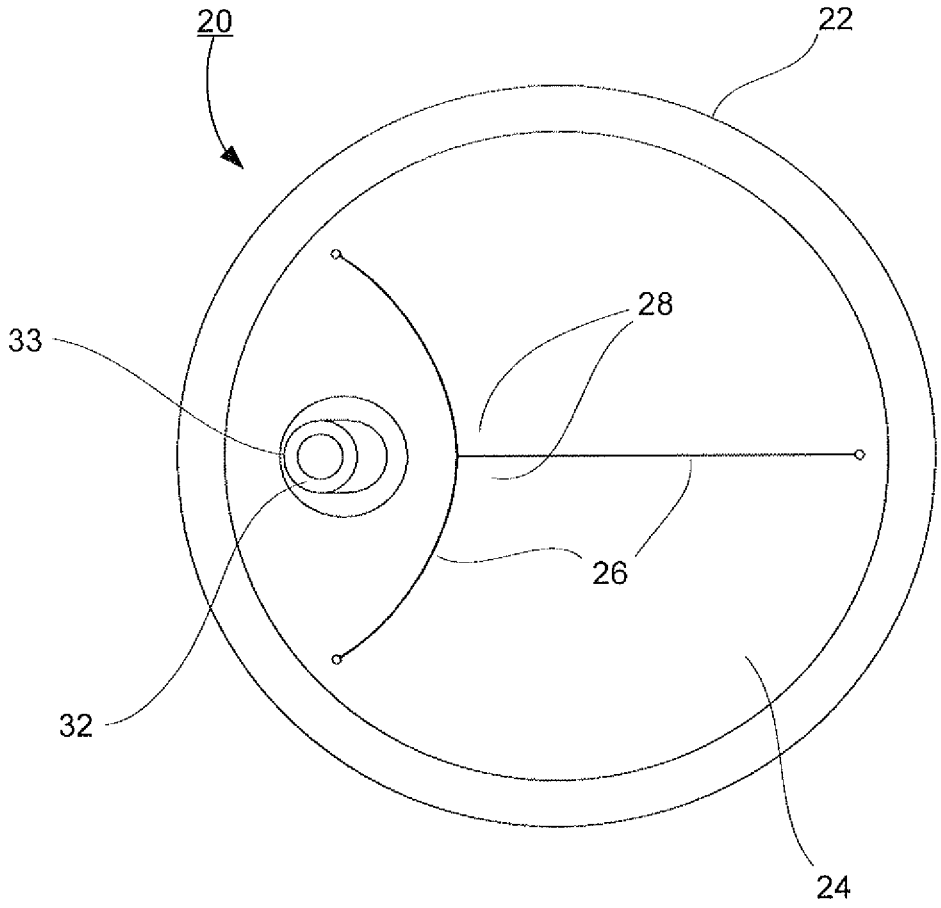
FIG. 3 is a top view of the integrated container.
Figure 4:
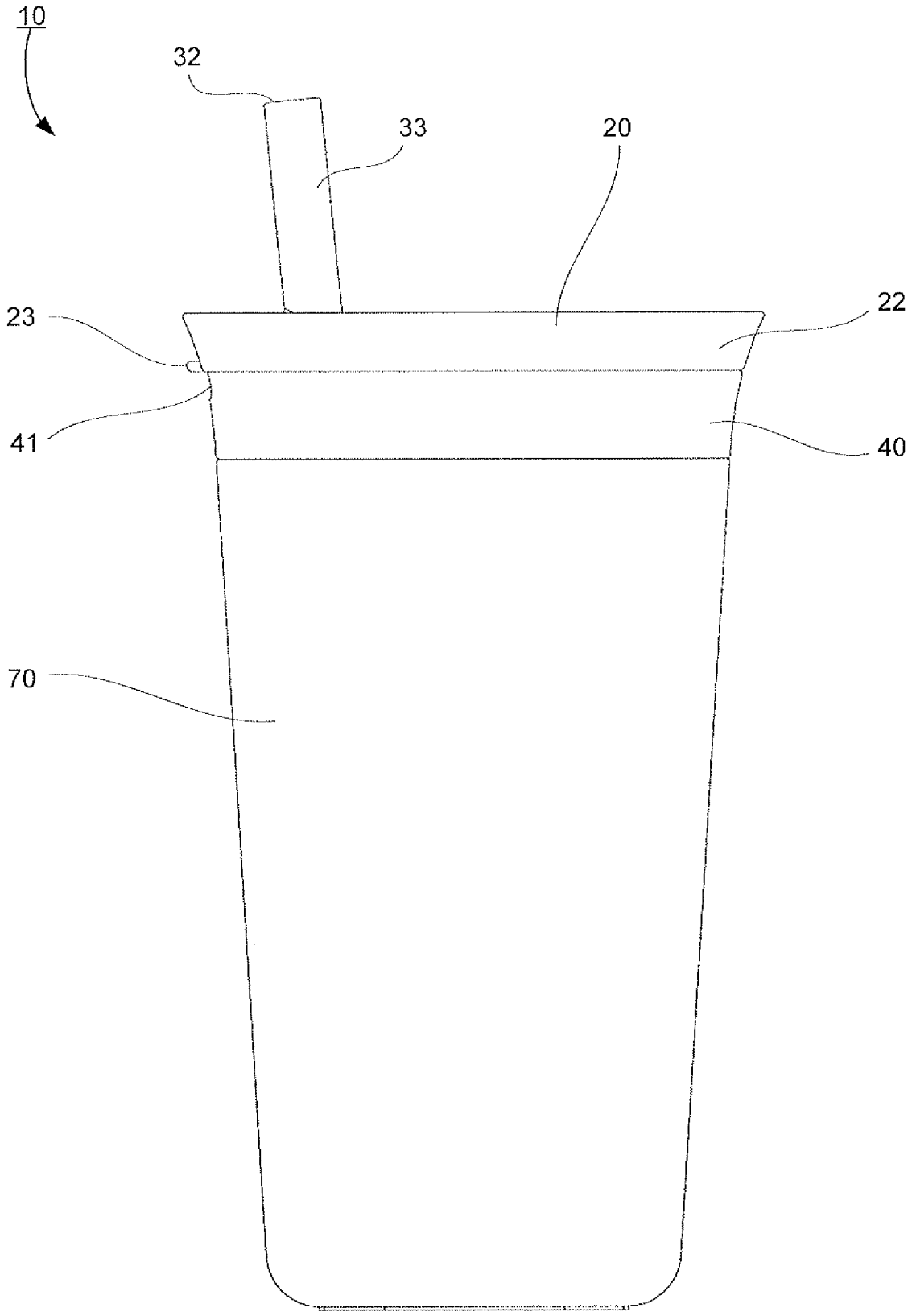
FIG. 4 is a front view of the integrated container.
Figure 5:
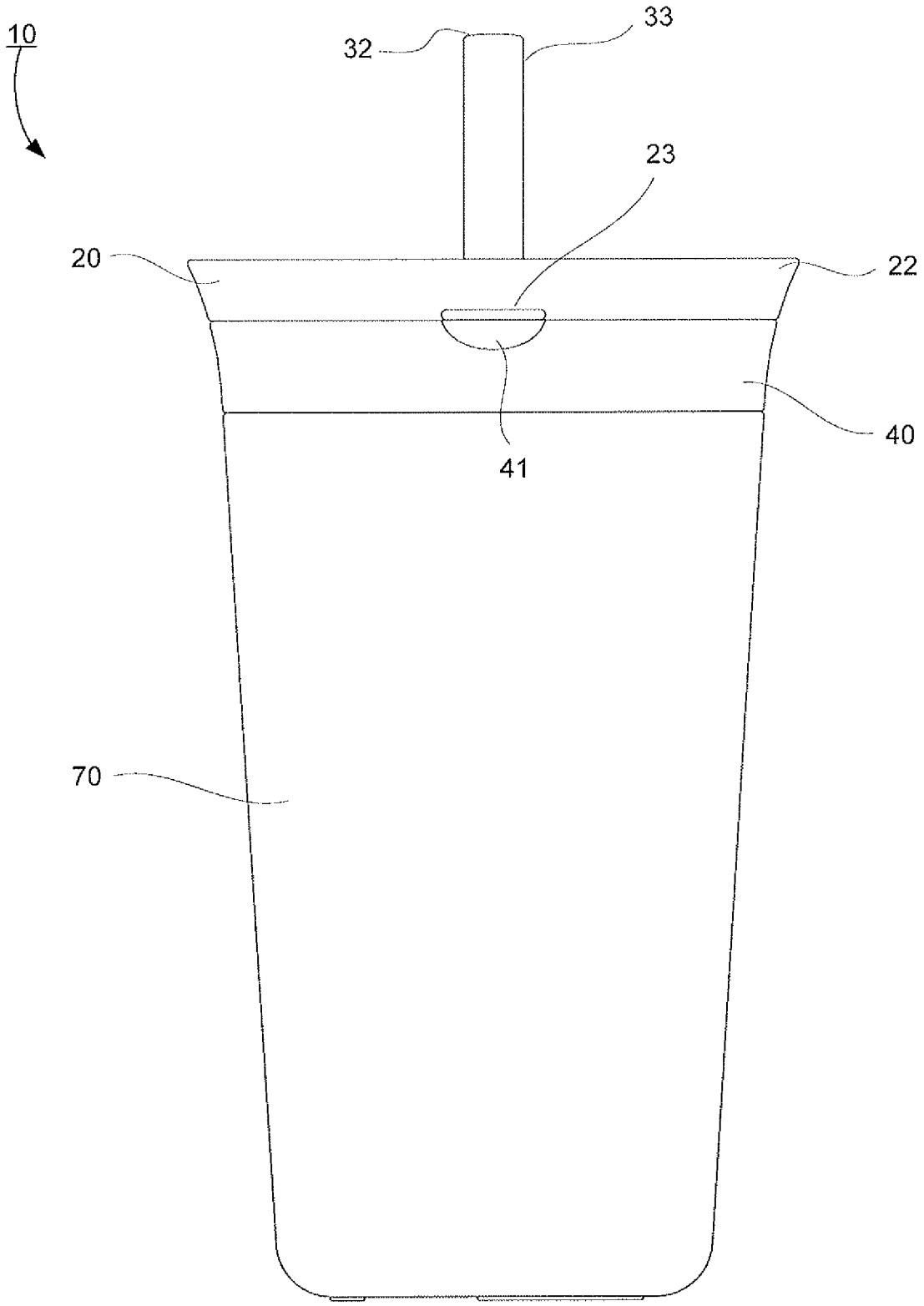
FIG. 5 is a side view of the integrated container.

FIGS. 2-3 show that the diaphragm 24 of the flexible cover 20 may include at least one, and preferably two or more slits 26 formed through the flexible portion or diaphragm 24 so that the slits 26 extend generally across the flexible portion of diaphragm 24. The slits 26 form at least one, and preferably several flaps 28 in diaphragm 24.

As shown in FIGS. 7, 10, 11, 13, the diaphragm 24 may alternatively include a plurality of openings or crossing slits 26 extending radially outwards and in a curved configuration from a center adjacent the central axis (A) towards a peripheral rim of the diaphragm 24 to form a circular row of tongues or flaps 28 there between. FIG. 17 shows a plurality of thicker and/or raised lips or ribs 127*a* surrounds an end 127 of the crossing slits 26 at a top surface and bottom surface of the diaphragm 24. These ribs 127*a* provide extra reinforcement to the ends 127 of the crossing slits 26 and prevent the repetitive movement and stress on the flaps 28 from tearing open the diaphragm 24 at the ends 127. Although not shown, raised ribs 127 may similarly be extended and disposed along the ends of the flaps 28 to provide extra reinforcement to the flaps 28 to prevent tearing of the flaps 28 and to further protect a user's hand from scratches. Although shown in FIG. 7 as circular, the raised ribs 127*a* may take on any other obtuse shape such as zigzag, rectangular, or the like consistent with the subject disclosure herein. While the openings 26 are shown adjacent to the central axis (A), the openings 26 may be disposed throughout the diaphragm in any location that allows sufficient access to the cavity, such as the openings or slits 26 extending about the flexible cover 20 between the outermost edges of a perimeter.

The flexible portion or diaphragm 24 of flexible cover 20 is constructed of a flexible material that will not scratch or otherwise injure a hand inserted through the slits 26 in the flexible portion or diaphragm 24 and into the inner chamber 48 of second container 40. Likewise, the flexible material will not catch the hand causing difficulty in removal thereof. The flexible cover 20 may be constructed of an opaque or a transparent material and may be of a one-piece construction with the remainder of the flexible cover 20.

The flexible portion or diaphragm 24 of the flexible cover 20 may be formed of a material with a sufficient durometer. An example of a suitable derometer may be of equal to one in an approximate range of 40-100, and having a tear strength of equal to, or greater than 200 lb/in, or the like. Further, in the preferred embodiment, the material may have a melting point equal to, or greater than 150 degrees F. Various materials that meet these qualifications may be used. Some examples include, but are not limited to, thermoplastic polyurethane (TPU) or thermoplastic polyesters (TPE), as well as polyolefin Elastomers (POE). Examples of commercially available materials that meet the criteria are Engage, Sarlink, Texin, Desmopan, Dynaflex, Versalloy, Versaflex, and Elastolan. It should be noted that some or all of the above commercially available materials may be trademarks of the companies manufacturing and/or selling the materials.

As depicted in FIGS. 1 and 17, the flexible cover 20 may include a straw tip 33 made of a flexible material that extends through the diaphragm 24. As shown, the straw tip 33 is cylindrical in shape. However, it is to be understood that the straw tip 33 can be constructed of any geometrical shape that allows for suction through it. The integrated straw tip 33 has an upper portion 32 that extends above the diaphragm 24 and a lower portion 34 that extends below the diaphragm 24.

As shown in FIG. 6, a one-way valve 37 may be disposed in the straw tip 33 to allow one-way flow of the fluid from within the cavity 78 of the first container 70 out through the straw tip 33. Although shown as integral with the diaphragm 24, the straw tip 33 may be configured in any other construction that allows suction therethrough.

Figure 15:
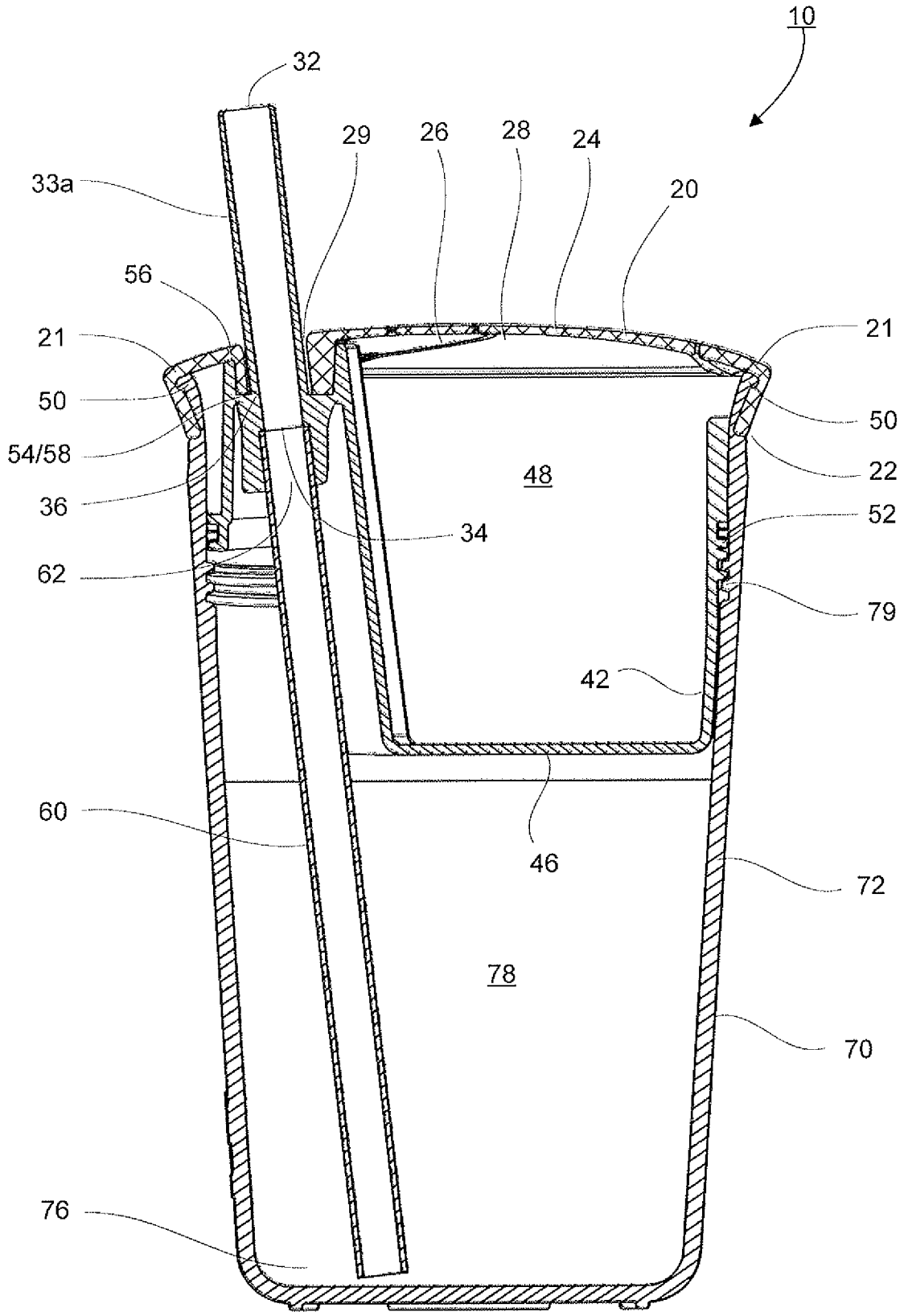
FIG. 15 is a cross section view of a fifth embodiment in the assembled position.
Figure 16:
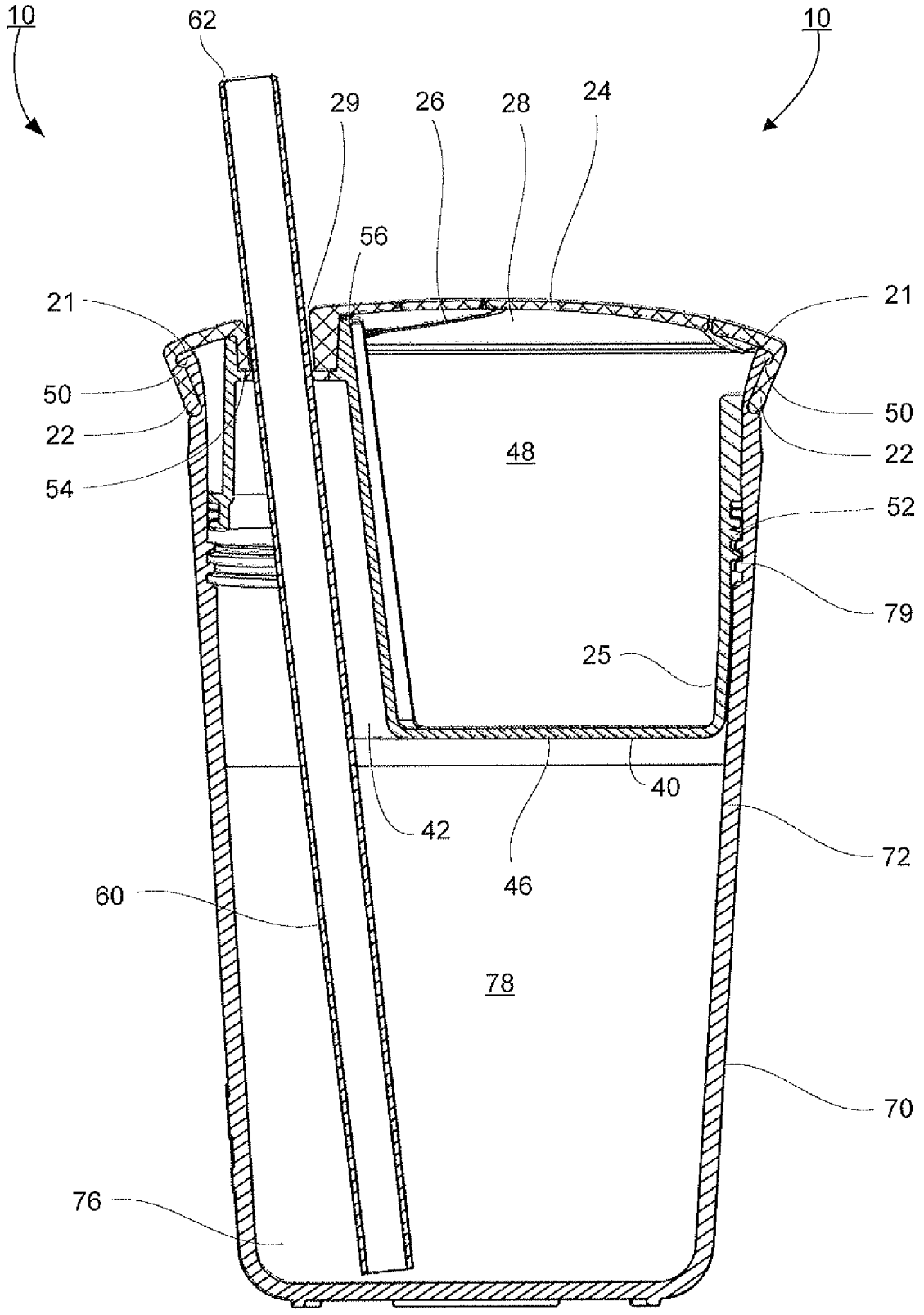
FIG. 16 is a cross section view of a sixth embodiment in the assembled position.

FIGS. 15-16 show various constructions for the straw tip 33 that can be configured according to this subject disclosure. It is also contemplated that the straw tip 33 may be either detachably or permanently connected to the second container 40. One example of such a connection is depicted in FIG. 15. In this embodiment, the flexible cover 20 has a cover aperture 29 for a straw tip 33*a* to fit through.

FIG. 16 further contemplates another embodiment in which a separate straw tip is not provided. Instead, the straw 60 extends from the cavity 78 in the first container 70 through a straw port 54 in the second container 40 and across the diaphragm 24 of the flexible cover 20, exposing the upper end 62 of the straw 60. A cover aperture 29 is provided in the cover 20 through which the straw 60 is disposed. The resilient material of the cover 20 acts to seal the straw 60 through the cover 20 to prevent leakage between the straw 60 and the cover aperture 29. Although not shown, a valve may be provided within the straw 60 to prevent spillage therethrough.

Referring back to FIG. 6, the lower portion 34 of the straw tip 33 may include an indentation 36 that couples or seals with the second container 40. The indentation 36 is disposed in the resilient material of the straw tip 33 which functions as a water tight seal. The indentation 36 is adapted to provide a seal between the straw tip 33, the second container 40 and the cavity 78 in the first container 70. A mating protrusion 58 may be provided in the through port 54 of the second container 40. The indentation 36 and the protrusion 58 are matingly engaged to provide the seal.

The lower portion 34 of the straw tip 33 may include a tapered sleeve 38 and a straw holder 31 dimensioned to receive an upper portion 62 of the straw 60 to seal the lower portion 34 of the straw tip 33 in assembly. The tapered sleeve 38 provides easier access to a user to both install and remove the upper end 62 of the straw 60 to the straw tip 33. The tapered sleeve 38 further provides reduced friction to allow easier installation and removal of the straw tip 33 into and out of from the straw port 54, while also maintaining sufficient friction to remain properly seated in the straw port 54 while in use.

As shown in FIGS. 6 and 17, the straw holder 31 may be of a wider width opening to accommodate the upper end 62 of a straw 60. Although shown to be wider, the straw holder 31 may be of any suitable size or shape to hold the straw 60 in place.

As shown in FIGS. 8, 12-14 and 17, an installation tab 35 capable of being pulled to guide the straw tip 33 properly into a straw port 154 may be attached adjacent to the lower portion 34 of the straw tip 33. The installation tab 35 is preferably thinner than the lower portion 34 of the straw tip 33 to avoid friction between the installation tab 35 and the straw port 154. Although shown as thinner and in a tubular shape, the installation tab 35 may take any suitable shape that allows a user to pull and guide the lower portion 34 of the straw tip 33 into the straw port 154.

The second container 40 is shown in FIGS. 1, 6-8 and 11-16 as substantially cylindrical in shape and is adapted to fit within the first open end 74 of the first container 70. However, it is to be understood that the second container 40 may be any geometric shape that provides sufficient access to a cavity 48.

Alternatively (but not shown), the second container 40 may be adapted to receive the first open end 74 of the first container 70 wherein the first container 70 is adapted to fit within an outer periphery of the second container 40. The second container 40 then has an additional sidewall that forms a recess for the first container 70 to be received and secured. The substantially cylindrical shape of the first container 70, the cover flexible cover 20, and the second container 40 are all axially aligned with the central axis (A). However, it is also contemplated that the individual components may not align with the central axis A for a more obtuse design.

The second container 40 has side wall 42, a first open end 44 and a bottom surface or a second closed end 46. The first open end 44 may have a wider width to allow for better accessibility by a user and a tapered or frustoconically downwardly and inwardly slope to further provide easy and precise access to the cavity 48. The second container 40 includes an outwardly projecting lip 50 around its open end 44. The outwardly projecting lip 50 helps hold the flexible cover 20 in place during usage.

As shown in FIGS. 1, 6-8 and 12-16, the first open end 44 of the second container 40 opens to at least one cavity 48 adapted to receive an item stored therein. It is to be understood that second container 40 can take any suitable size or shape capable of holding items that fit within the first container 70. Furthermore, it is also within this disclosure that the second container 40 can have a plurality of compartments disposed therein, divided by removable or permanent dividers.

As shown in FIGS. 1 and 6, the straw port 54 of the second container 40 provides an opening through which the straw tip 33 and the straw 60 are located in a spill proof manner. During assembly, the lower end 34 of the straw tip 33 is aligned with the straw port 54 and disposed therein for a tight leakproof seal between the flexible cover 20 and the second container 40.

Figure 11:
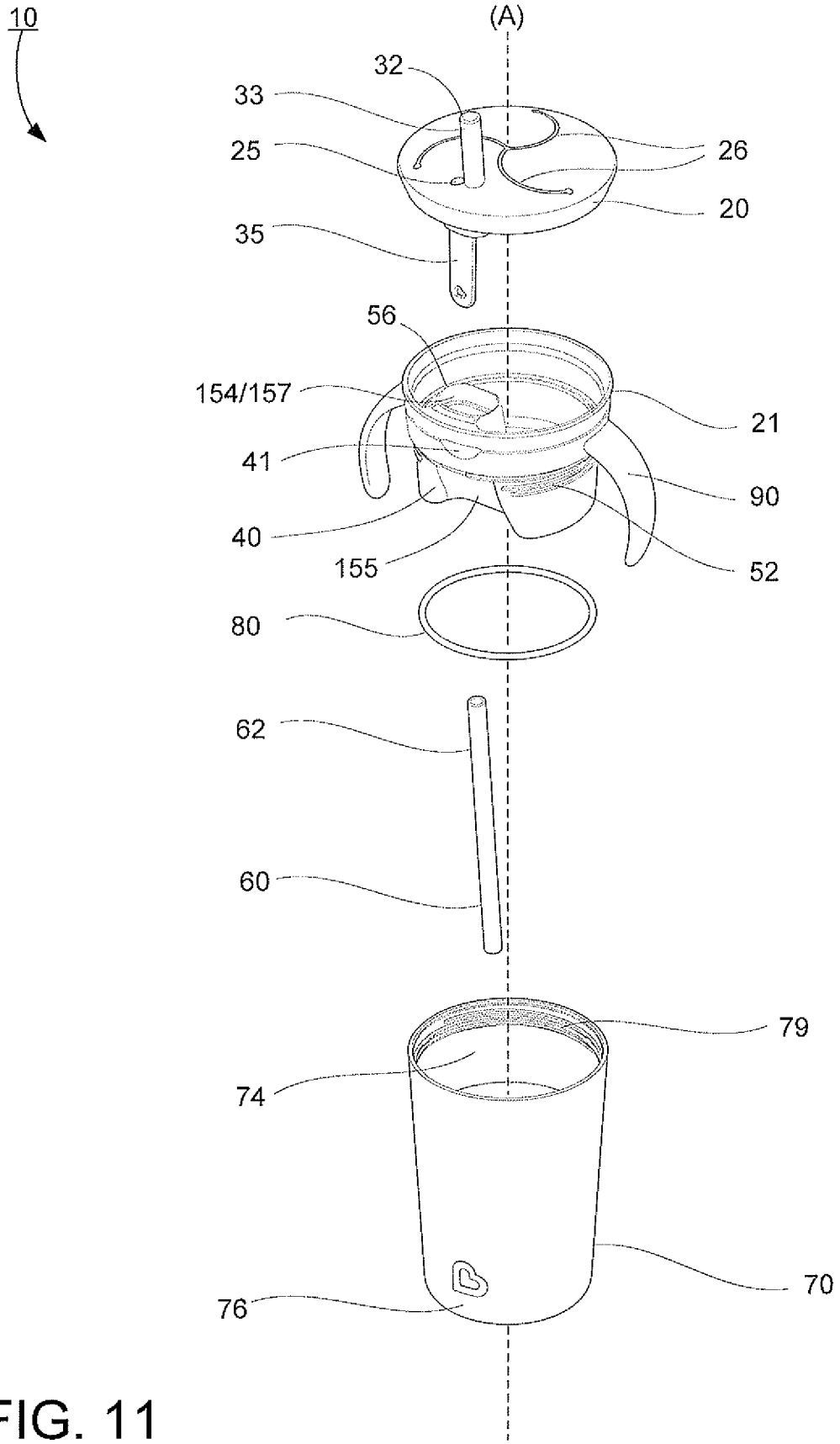
FIG. 11 is an exploded perspective view of FIG. 8.
Figure 13:
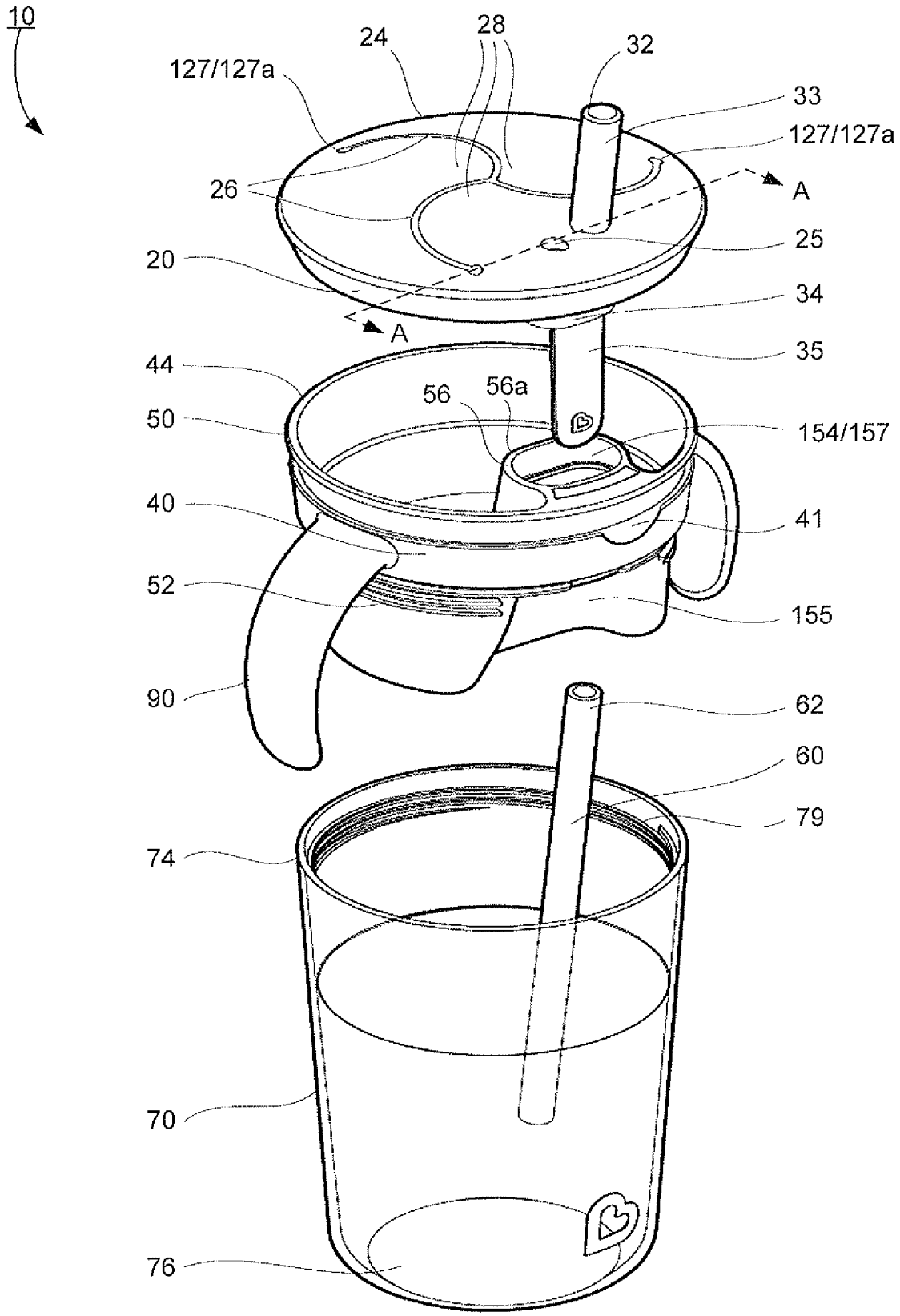
FIG. 13 is an exploded perspective view of FIG. 12.

As shown in FIGS. 11 and 13, a similar straw port 154 may be used in place of straw port 54, allowing for a larger width lower portion 34 of straw tip 33 to fit therethrough. This embodiment allows for further options, such as an air port 83 and air valve 85 disposed in and through flexible cover 20 and lower portion 34 of straw tip 33. This also allows installation tab 35 to fit therethrough.

As further depicted in FIGS. 1, 6, 8 and 11-16, the second container 40 may also include a stop flange 56. The stop flange 56 extends upward to a predetermined height. The stop flange 56 assists in the later stability of the flexible diaphragm 24 disposed over the open end 44 of the second container 40. When the flexible cover 20 is assembled over the second container 40, a lower surface of the flexible cover 20, typically the lower portion 34 of the straw tip 33, comes into contact with an upper end **56*a* of the stop flange 56 and acts as a stop to limit the height such that when the flexible cover 20 is assembled over the second container 40, the flexible cover 20 can be positioned and limit the amount of sag or flex in the flexible cover 20. The stop flange 56 therefore provides lateral support for the flexible cover 20. The stop flange 56 may also be one integral unit with the straw port 54. Although shown in FIG. 1 as semi-circular and circular in FIG. 7, the stop flange 56 may take any suitable shape that provides support and allows the straw tip 33 to be disposed adjacent to, or within the stop flange 56**.

As shown in FIGS. 1, 6-8 and 11-16, the second container 40 includes a coupling element 52 on an outer surface to securely couple the second container 40 to the first container 70. The coupling element 52 may be constructed in a variety of different ways. The coupling element 52 may be a set of threads **52*a* adapted to interact with another coupling element 79 such as mating threads 79*a* disposed on an inner surface of the first container 70. In an embodiment where the first container 70 is recessed into or received by the second container 40, the threads 52*a* may be disposed on an inner surface of the additional sidewall of the second container 40 and the mating threads 79*a* may be disposed on an outer surface of the first container 70. In use, the threads 52*a* on the second container 40 are threaded with the threads 79*a* on the first container 70 in order to secure the second container 40 to the first container 70**. It is to be understood that the coupling elements can be any suitable method of securing the two units together, including but not limited to threads, a friction fit, click-on, hinges or the like.

Figure 14:
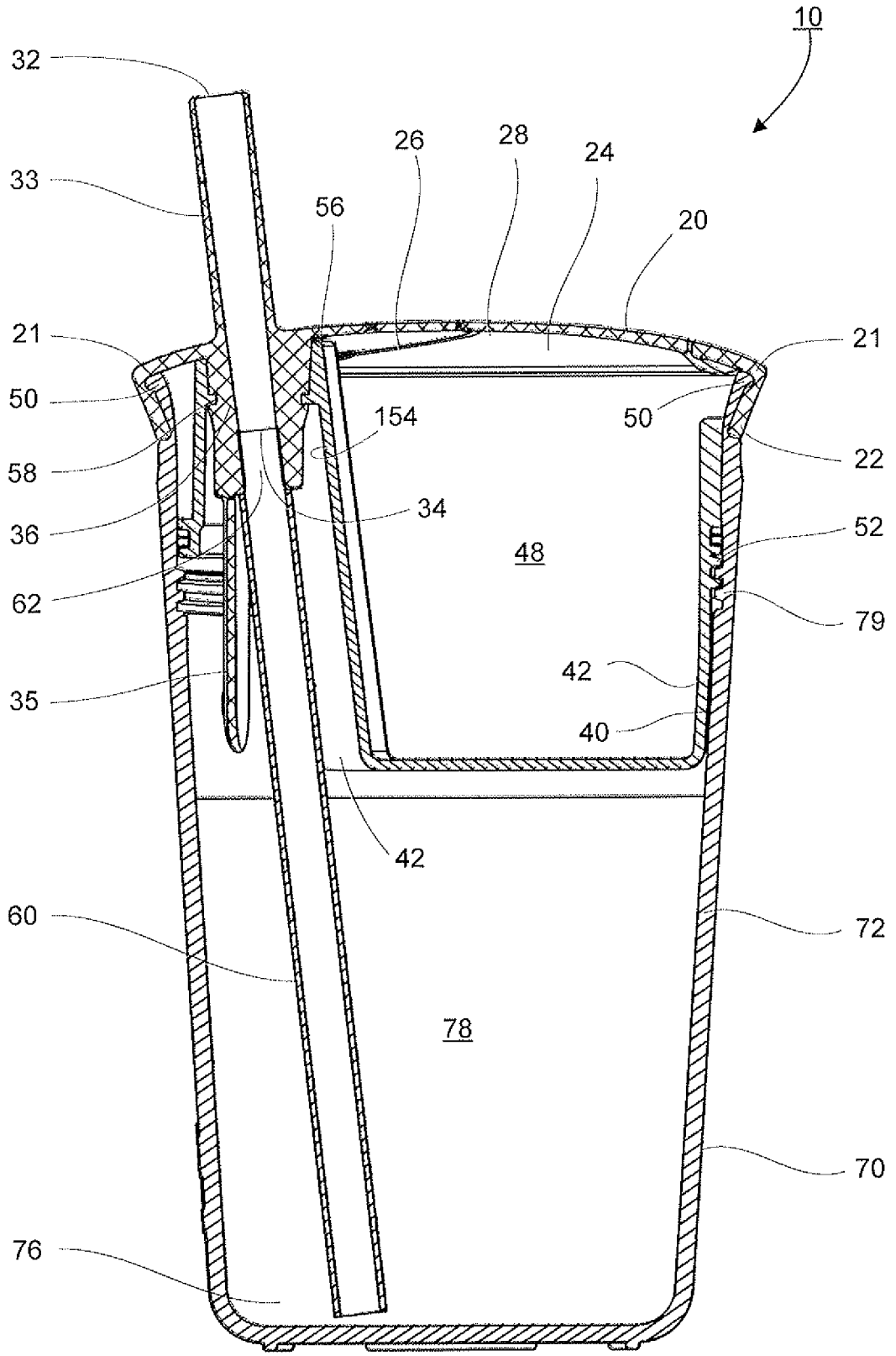
FIG. 14 is a cross section view of a fourth embodiment in the assembled position.

As depicted in FIGS. 14-16, it is also contemplated that the integrated container 10 can be designed such that the second container 40 is wholly recessed into the first container 70. In this configuration, the flexible cover 20 can act as a seal. For example, the flexible cover 20 may utilize annular recess 21 of the annular flange 22 to cover a projecting lip 50 of the first container 70 to create a leakproof seal. In other words, in this configuration, the first container 70 may contain the projecting lip 50 to allow the flexible cover 20 to attach directly onto the first container 70. This embodiment of the second container 40 can still retain the straw port 54 construction as discussed above and may also be substantially aligned with central axis (A).

As shown in FIG. 8, use of another object, such as an O-ring 80, can also be used as a seal between the first container and the second container. Although only shown in one embodiment, the usage of an O-ring is understood to be usable in any other embodiment as a seal.

Figure 7:
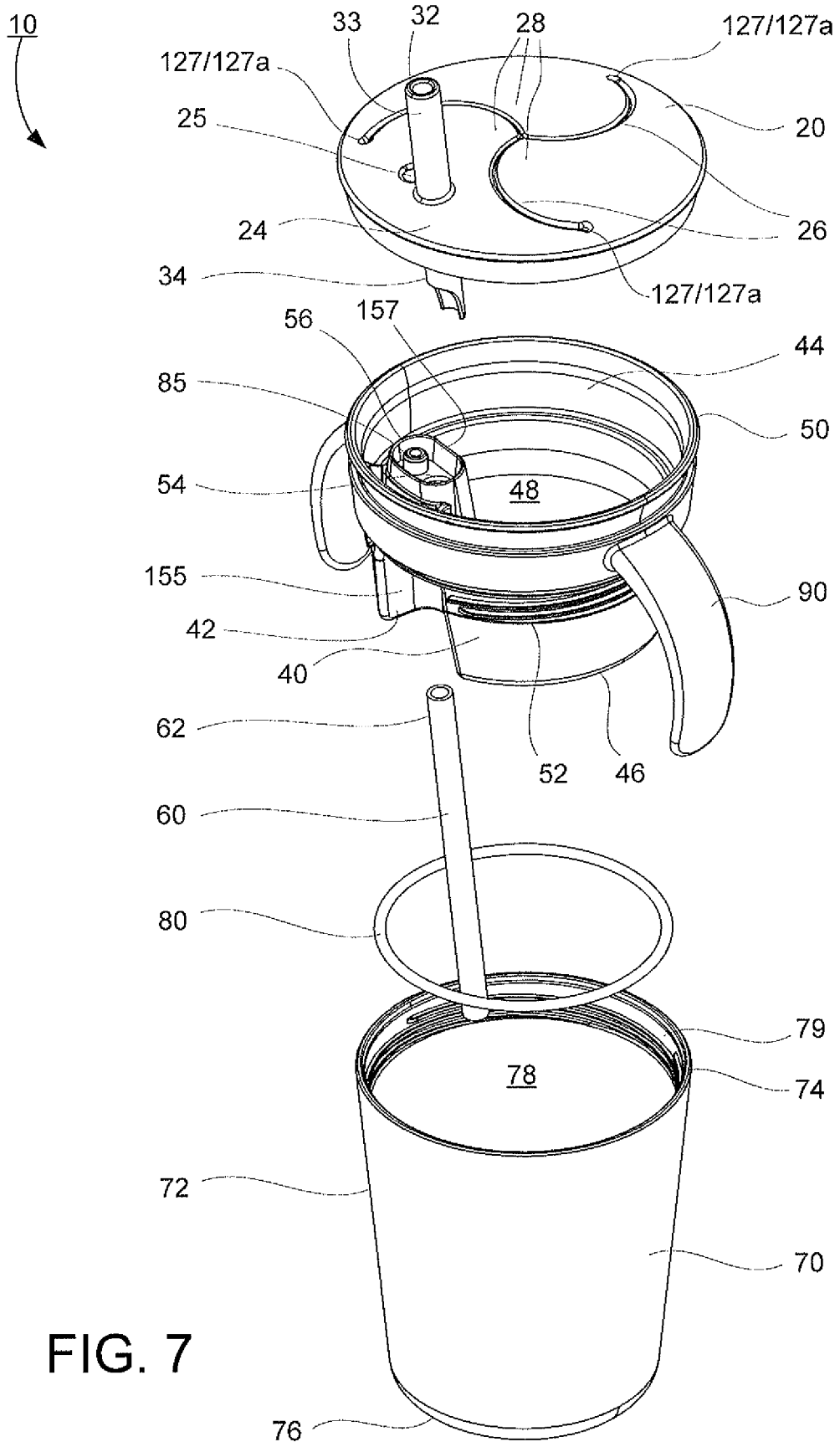
FIG. 7 is an exploded perspective view of a second embodiment of the integrated container.
Figure 8:
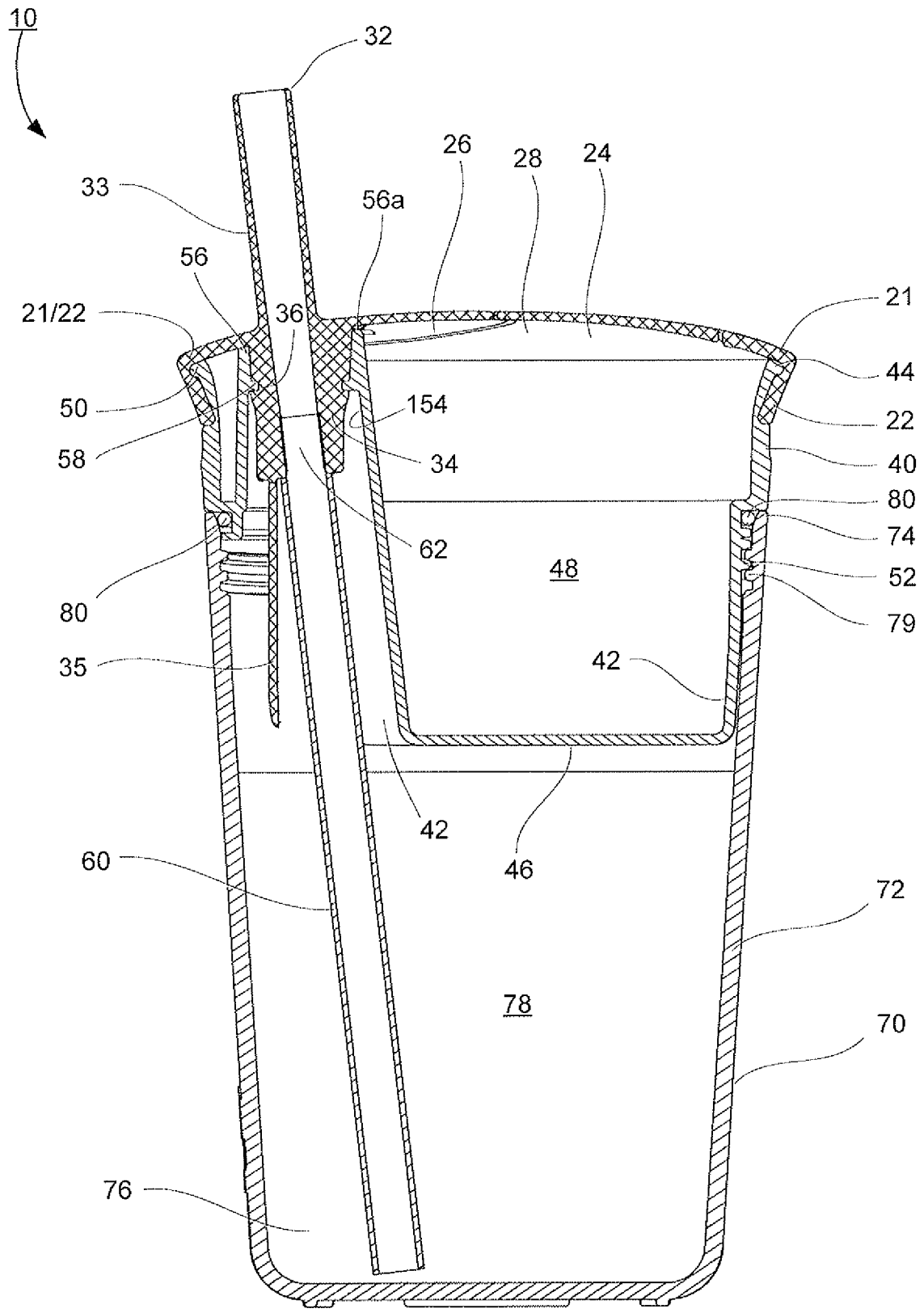
FIG. 8 is a cross sectional view of a third embodiment in an assembled position.
Figure 9:
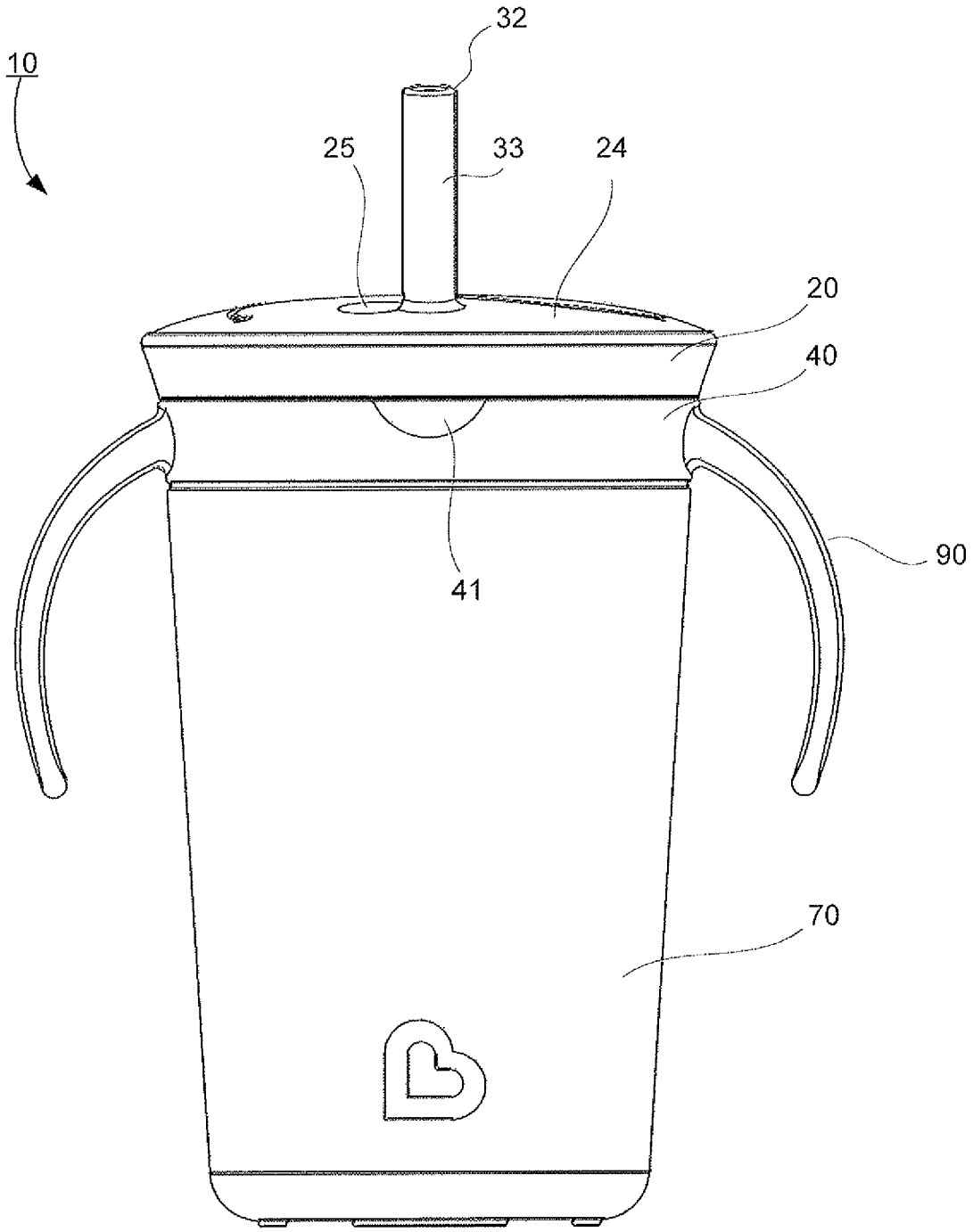
FIG. 9 is a side view of FIG. 8 in the assembled position.
Figure 10:
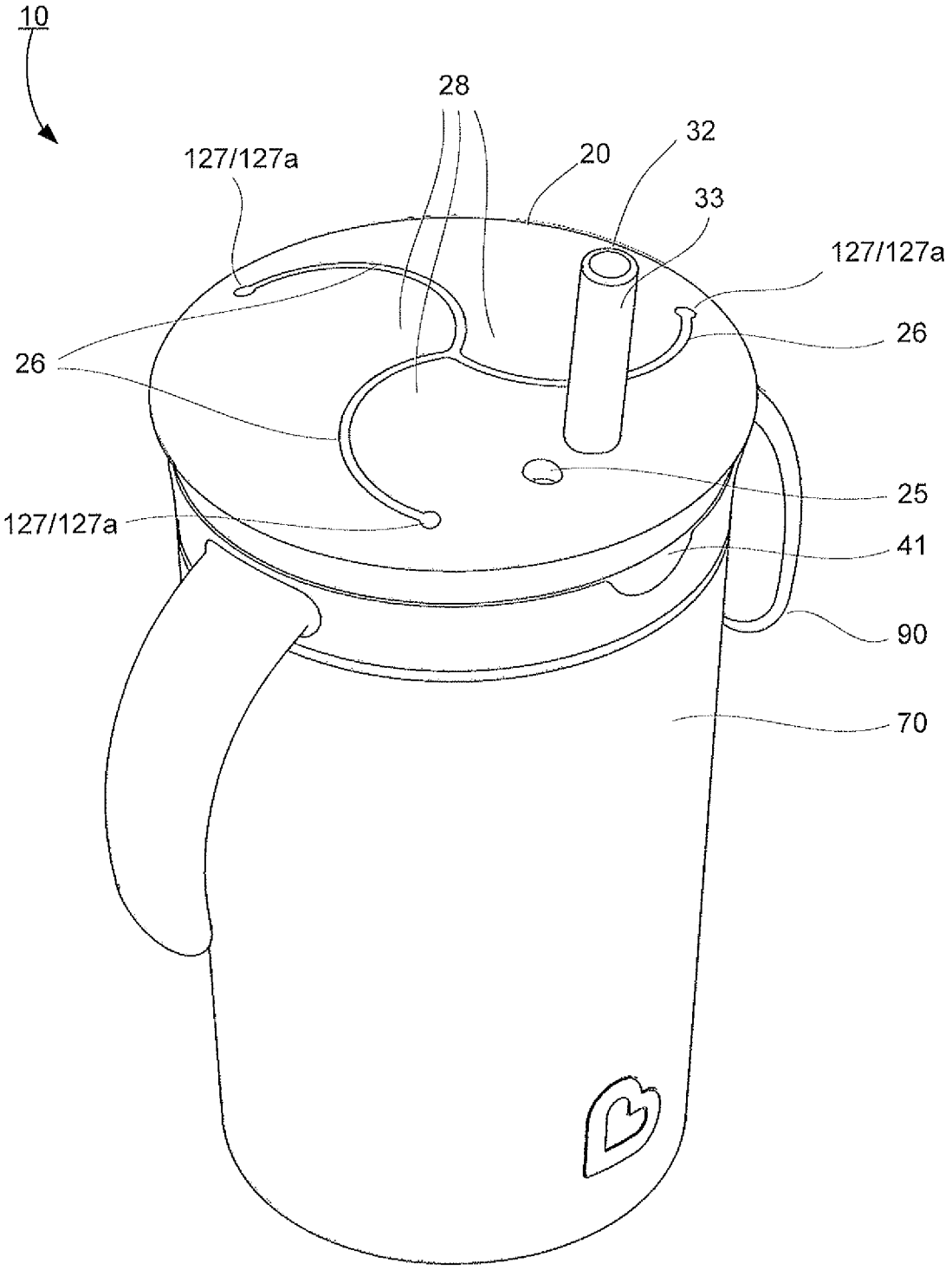
FIG. 10 is an upper perspective view of FIG. 8 in the assembled position.

As FIGS. 1, 2 and 7 depict, the first container 70 can be substantially cylindrical in shape substantially about a central axis (A). The first container 70 has a side wall 72, a first open end 74 and a second closed end 76. The first open end 74 of the first container 70 opens to a beverage cavity 78 adapted to receive a fluid stored within the first container 70. It is to be understood that first container 70 can take any suitable size or shape capable of holding a fluid or other item, such as a square shape or other suitable obtuse shape.

FIGS. 7-8 illustrate another embodiment of the subject disclosure having additional components. As shown in FIG. 7, the integrated container 10 further includes a sealing ring or O-ring 80, a pair of removable or permanently integrated handles 90, an air valve 85, a through port 155, a straw port 154, and a plurality of slits 26.

As shown in FIGS. 7, 8 and 11, the O-ring 80 is shown as substantially circular in cross-section and cylindrical in shape and is adapted to fit between the first container 70 and the second container 40. It is to be understood that the O-ring 80 may take any suitable shape to create a waterproof seal or seal tight closure. When the integrated container 10 is in the closed position, as shown in FIG. 8, the O-ring 80 securely sits above the threads 52 located on the second container 40 to create a waterproof seal or seal tight closure between the second container 40 and the first container 70. It is to be understood that the O-ring 80 may be optimally positioned in other locations to create a waterproof seal or seal tight closure.

FIG. 7 illustrates the integrated container 10, via the first container 70 or the second container 40 may also include a pair of integrated handles 90. The handles 90 may extend from a side wall of the second container 40, just below the annular flange 22 to a free end. The handles 90 have a slight downward curvature as depicted but it is to be understood that the handles may take any suitable shape to allow for grippability.

Figure 12:
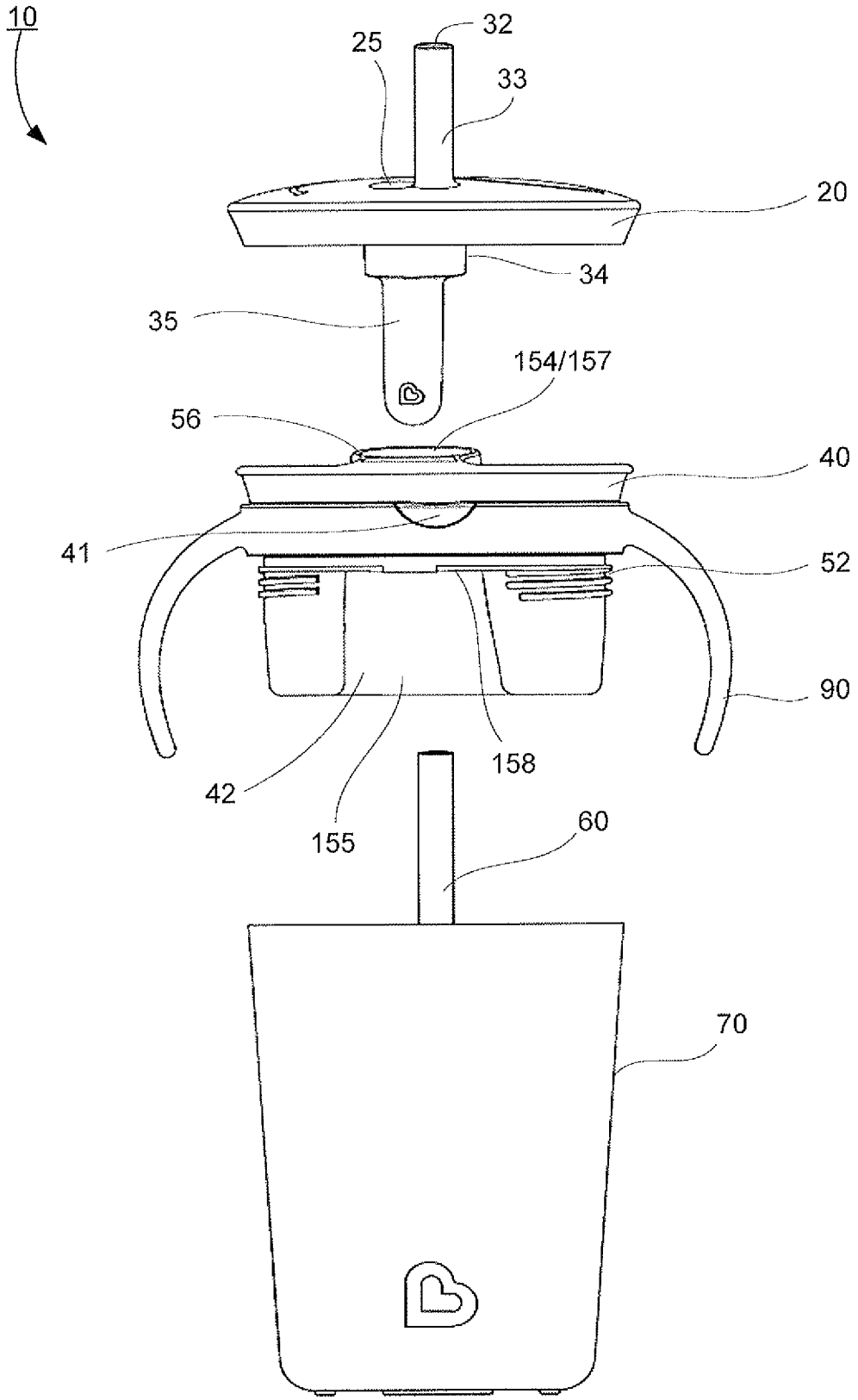
FIG. 12 is an exploded side view of a third embodiment of the integrated container.

The second container 40 may also include a through port 155 integrated into the second container 40 that extends through the second container 40. The through port 155 is recessed in and defined by sidewall 42 that extends from the first open end of the second container 40 through the second container 40 to the second closed end 46 of the second container 40. As shown in FIGS. 6 and 12, the through port 155 may have an upper open portion 157 that extends from an uppermost point of the stop flange 56 to an intermediate point 158 of the second container 40. As shown in FIGS. 1 and 11-13, the upper open portion 157 may be one integral unit with the stop flange 56 and/or the straw port 54. Alternatively, as shown in FIG. 7, the open upper portion 157 may be a separate structure from the stop flange 56 and may be adjacent the stop flange 56 and/or the straw port 54.

As shown in FIG. 17, an air port 83 may sit adjacent to the straw port 154 and disposed within the flexible cover 20. The air port 83 may be of one unit, as shown in FIG. 17, or a combination of the more than one unit, as shown in FIG. 7, wherein an air valve 85 is disposed within the air port 83 and the aperture 25. The air port 83, would then have the air port 83 disposed within second container 40, the air valve 85 and the aperture 25 above to create one elongated channel for air flow. The air port 83 is shown to be cylindrical, but may take any shape suitable to allow air therethrough.

As further shown in FIG. 17, an air valve 85 may be disposed within air port 83. FIG. 7 shows the air port 83 and air valve 85 disposed in the second container 40, but it is to be understood that the air port 83 and air valve 85 may be located in any location that allows proper air regulation. The air valve 85 allows or restricts one-way air movement through the second container 40 from the first container 70 and consequently prevents a vacuum from forming when a user sucks through the straw 60. Although the air valve 85 is shown as cylindrical in shape, it is understood that it may take any shape suitable to allow or restrict air from the first container 70.

As shown in FIGS. 7, 9-13 and 17, an aperture 25 in the flexible cover 20 will be provided when an air port 83 and air valve 85 is present in the integrated container 10 to properly allow air flow regulation. As shown in FIG. 17, the air port 83 and valve 85 may be integrated in the aperture 25. Alternatively, as shown in FIG. 7, the air port 83 and air valve 85 and the aperture 25 may be two separate structures. It is to be understood that the aperture 25 may be located in any location in relation to the air valve 85 that provides proper regulation of air flow.

It is to be understood that the integrated container can have a variety of other uses, such as a plurality of storage compartments for holding various small tools, or the like. Similarly, the integrated container may have a plurality of liquid compartments with a plurality of similar straw assembly structures. Likewise, the integrated container may have other applications to assist various individuals having dexterity and difficulty securely holding various items. The self contained integrated nature of the subject disclosure is an advantage over utilizing separate containers for a beverage and for snacks, or the like.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. An integrated anti-spill container, comprising:

a first container;

a second container attached to the first container, the second container having a through port;

a flexible cover secured over at least one of the second container or the first container, the flexible cover having an aperture and slit openings formed through the flexible cover in order to access a first compartment within the second container, the flexible cover having a lower portion disposed in the through port; and a straw extending from and in contact with the lower portion of the flexible cover into the first container.

2. The integrated anti-spill container in claim 1, wherein the flexible cover has a straw tip align with the lower portion of the flexible cover, wherein an upper end of the straw is disposed within the lower portion of the flexible cover in an assembled position.

3. The integrated anti-spill container in claim 2, wherein the lower portion of the flexible cover having a straw holder, such that the upper end of the straw is disposed within the straw holder in an assembled position.

4. The integrated anti-spill container in claim 2, further comprising a one-way valve disposed in the flexible cover.

5. The integrated anti-spill container in claim 2, wherein the lower portion of the flexible cover further comprises an installation tab.

6. The integrated anti-spill container in claim 2, wherein the lower portion of the flexible cover having an indentation to fit a protrusion on the through port.

7. The integrated anti-spill container in claim 1, further comprising an air port disposed within the flexible cover.

8. The integrated anti-spill container in claim 7, further comprising an air valve disposed within the air port.

9. The integrated anti-spill container in claim 1, further comprising a stop flange disposed within the second container.

10. An integrated anti-spill container, comprising:

a first container;

a second container connected to the first container, the second container having a through port, the through port containing an upper open portion with walls that extend therefrom through the second container toward a bottom surface;

a flexible cover secured over at least one of the first container or the second container, the flexible cover has a straw tip having an upper portion and a lower portion, the lower portion disposed in the through port, the flexible cover having an aperture and slit openings formed through the flexible cover in order to access a first compartment within the second container; and a tube extending from within the lower portion of the straw tip into the first container.

11. The integrated anti-spill container in claim 10, wherein an upper end of the tube is disposed within a straw holder in the lower portion of the straw tip in an assembled position.

12. The integrated anti-spill container in claim 11, further comprising a one-way valve disposed in the straw tip.

13. The integrated anti-spill container in claim 12, wherein the flexible cover further comprises an air valve.

14. The integrated anti-spill container in claim 10, wherein the second container further comprises an air port disposed adjacent to the through port, such that the aperture in the flexible cover aligns with the air port of the second container.

15. The integrated anti-spill container in claim 14, wherein the air port further comprises an air valve.

16. An integrated anti-spill container, comprising:

a first container;

a second container disposed within and attached to the first container, the second container having a port containing an upper open portion with walls that extend through the second container towards a closed end; and a flexible cover secured over at least one of the first and second containers, the flexible cover having an aperture and slit openings formed therethrough in order to access a first compartment within the second container, the flexible cover having a straw tip, the straw tip having a lower portion, the lower portion being positioned in the port, the lower portion having a straw holder to receive a straw.

17. The integrated anti-spill container in claim 16, further comprising a stop flange integrated with the port.

18. The integrated anti-spill container in claim 16, wherein the second container further comprises an air port, the air port having an air valve disposed therein.

19. The integrated anti-spill container in claim 16, wherein an installation tab is attached to the lower portion of the straw tip.

20. The integrated anti-spill container in claim 16, wherein the port has a protrusion and the lower portion of the straw tip has an indentation, such that when in an assembled position, the protrusion fits into the indentation.

* * * * *